US007497434B2

(12) United States Patent
Park

(10) Patent No.: US 7,497,434 B2
(45) Date of Patent: Mar. 3, 2009

(54) PAPER FEEDING CASSETTE OF IMAGE FORMING APPARATUS

(75) Inventor: Gyeong-ho Park, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 379 days.

(21) Appl. No.: 11/020,130

(22) Filed: Dec. 27, 2004

(65) Prior Publication Data

US 2005/0151314 A1 Jul. 14, 2005

(30) Foreign Application Priority Data

Jan. 9, 2004 (KR) ..... 10-2004-0001669

(51) Int. Cl.
*B65H 1/08* (2006.01)
*B65H 1/26* (2006.01)

(52) U.S. Cl. ..... 271/127; 271/126; 271/145; 271/147; 271/157; 271/155

(58) Field of Classification Search ..... 271/127, 271/126, 145, 152, 147, 155, 157
See application file for complete search history.

(56) References Cited

U.S. PATENT DOCUMENTS 4,763,891 A 8/1988 Kodama
4,958,950 A 9/1990 Kobayashi et al.
5,100,122 A 3/1992 Noda et al.
5,228,676 A * 7/1993 Arai et al. ..... 271/117
5,228,677 A * 7/1993 Asakawa ..... 271/126
6,361,038 B1 * 3/2002 Tada et al. ..... 271/111
6,422,773 B1 * 7/2002 Lim ..... 400/710
6,443,445 B1 * 9/2002 Bortolotti ..... 271/117
6,862,426 B2 * 3/2005 Kitamura ..... 399/393

FOREIGN PATENT DOCUMENTS

EP 0675415 A2 4/1995
JP 06056283 A * 3/1994
JP 08-059023 3/1996
KR 2001-297759 B1 5/2001

* cited by examiner

*Primary Examiner*—Patrick H Mackey
*Assistant Examiner*—Luis Gonzalez
(74) *Attorney, Agent, or Firm*—Stanzione & Kim, LLP

(57) ABSTRACT

A paper feeing cassette of an image forming apparatus includes a paper stacking plate on which a sheet of paper is stacked; a lift unit placed under the paper stacking plate, lifting by a rotating pivot, the rotating pivot being connected to a driving motor using a connection portion and rotated, and ascending the paper stacking plate; and a release unit separating the connection portion from the rotating pivot, disconnecting the driving motor from the rotating pivot, descending the paper stacking plate by its weight, and separating the sheet of paper from a pickup roller.

14 Claims, 8 Drawing Sheets

PAPER FEEDING CASSETTE OF IMAGE FORMING APPARATUS

CROSS-REFERENCE TO RELATED APPLICATIONS

This application claims the priority of Korean Patent Application No. 2004-1669, filed on Jan. 9, 2004, in the Korean Intellectual Property Office, the disclosure of which is incorporated herein in its entirety and by reference.

BACKGROUND OF THE INVENTION

1. Field of the Invention

The present general inventive concept relates to a paper feeding cassette of an image forming apparatus which stacks sheets of paper and can be attached or detached to or from a main body.

2. Description of the Related Art

In general, an image forming apparatus, such as a printer, a copier, or a multifunctional device, includes a paper feeding cassette which stacks a sheet of paper inside of the paper feeding cassette and is attached or detached to or from a main body. A paper stacking plate is installed inside the paper feeding cassette to lift the sheet of paper that is stacked on the paper stacking plate. Thus, the paper stacking plate allows the sheet of paper to contact a pickup roller installed in the main body, and the sheet of paper is picked up and transferred to an inside of the main body when the pickup roller is rotated.

A method of lifting the paper stacking plate in the paper feeding cassette is performed in two ways. First, the paper stacking plate is elastically biased in an upward direction by an elastic force of an elastic unit, such as a spring installed under the paper stacking plate. When a plurality of sheets of paper is stacked on the paper stacking plate, the paper stacking plate is lifted by the weight of the paper. This method is generally used in a case where an amount of the paper stacked on the paper feeding cassette is small. Second, when the amount of the paper stacked on the paper feeding cassette is large, like in a large copier, the weight of the paper cannot be supported using the elastic force of the elastic unit such as the spring. Thus, an additional device to lift the paper stacking plate is needed. In this method, an additional lift plate connected to a driving motor is used so that the lift plate is ascended and descended under the paper stacking plate.

U.S. Pat. No. 5,100,122 discloses an invention having the above structure. That is, a knock-up plate to stack paper in a feed cassette is installed, and a lift plate is installed under the knock-up plate while being fixed in a rotating pivot. A gear is installed at one side of the rotating pivot and is engaged with a gear installed in a lift plate driving motor.

The rotating pivot is rotated by a rotating force of the lift plate driving motor. The knock-up plate is lifted when the rotating pivot is rotated together with the lift plate. Then, the paper contacts a pickup roller installed above the paper feeding cassette. In this case, a sensor senses whether the paper is in contact with the pickup roller and allows the operation of the lift plate driving motor to stop when the paper contacts the pickup roller.

A frictional force by which the paper is picked up using the pickup roller is generated by a force by which the lift plate, based on the rotation of the lift plate driving motor, lifts the paper stacking plate.

However, when a controller does not control the lift plate driving motor, and the lift plate driving motor operates continuously although the sensor senses that the paper has contacted the pickup roller, the knock-up plate lifts continuously, and the paper is excessively pressed against the pickup roller. Furthermore, an operation of detaching the paper feeding cassette from the main body may not be performed smoothly.

SUMMARY OF THE INVENTION

The present general inventive concept provides a paper feeding cassette which descends a paper stacking plate compulsively to detach paper from a pickup roller when paper is excessively pressed by the pickup roller.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a paper feeing cassette of an image forming apparatus, the paper feeding cassette comprising a paper stacking plate to stack sheets of paper thereon; a lift unit placed under the paper stacking plate to ascend the paper stacking plate having a rotating pivot, a driving motor to rotate the rotating pivot, and a connection portion to connect the rotating pivot to the driving motor; and a release unit to separate the connection portion from the rotating pivot, to disconnect the driving motor from the rotating pivot, to cause the paper stacking plate to descend by its weight, and to separate the sheets of paper from a pickup roller.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
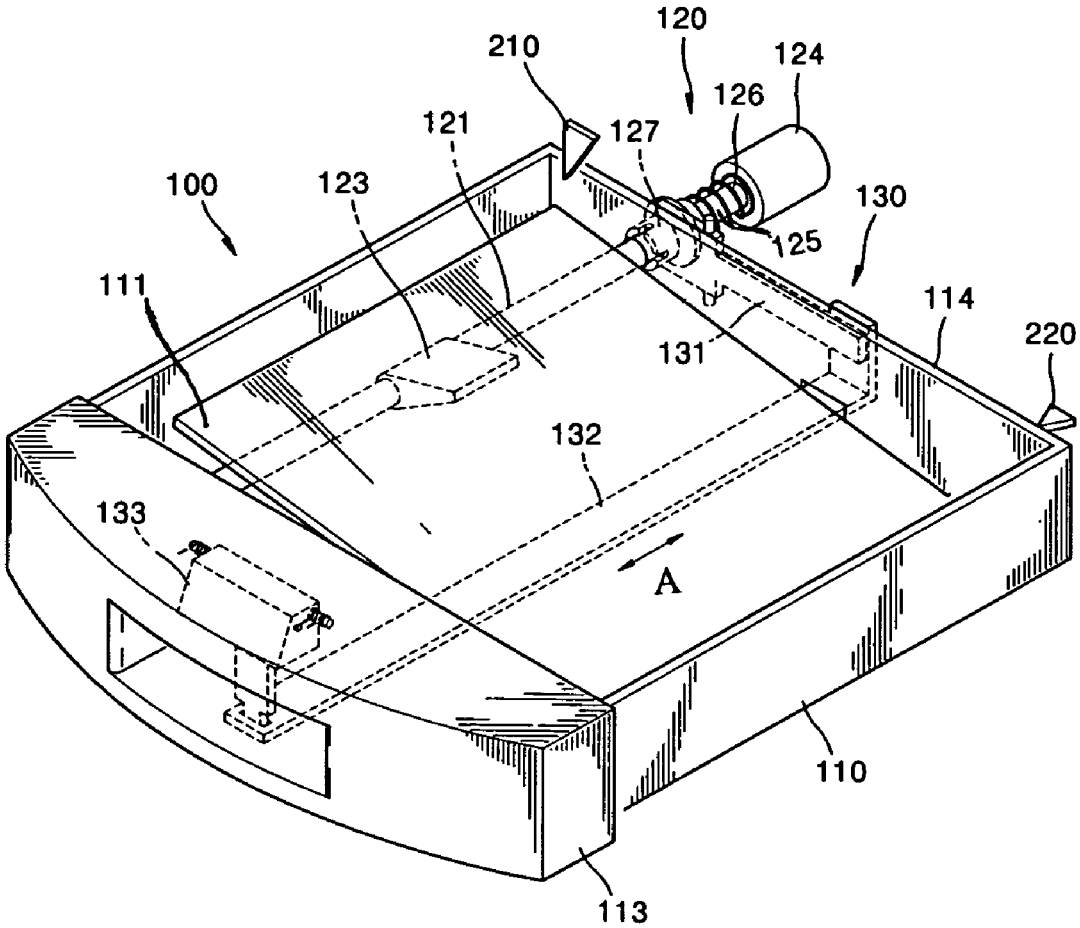
FIG. 1 is a perspective view illustrating a paper feeding cassette having a release unit according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
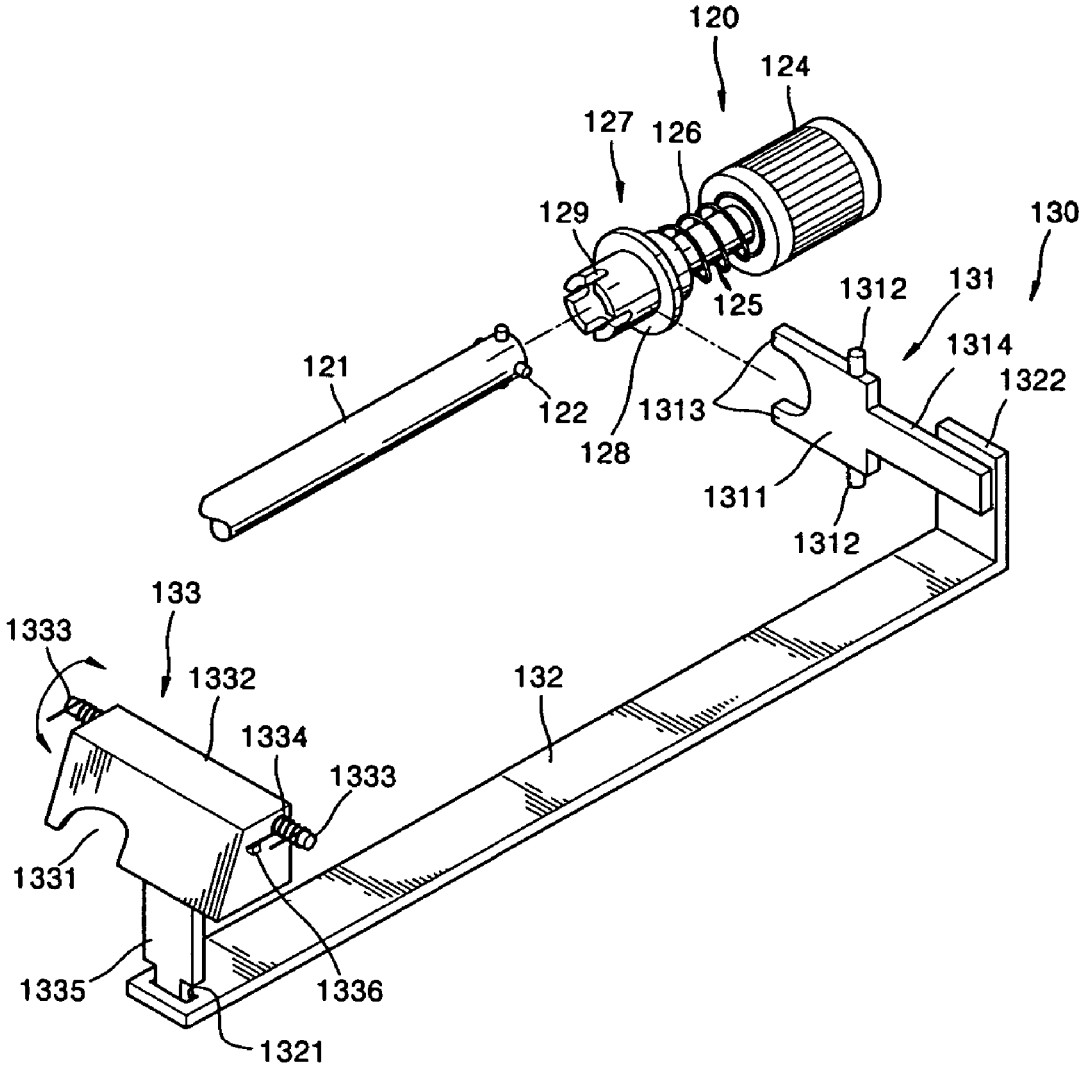
FIG. 2 is a perspective view illustrating the release unit of the paper feeding cassette of FIG. 1.
Figure 5:
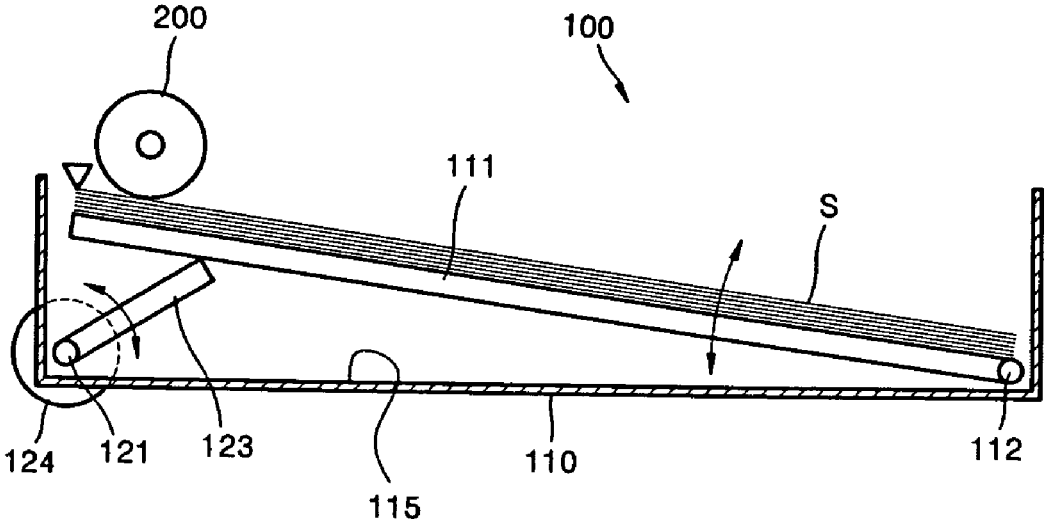
FIG. 5 is a cross-sectional view illustrating an operation of feeding a sheet of paper from the paper feeding cassette of FIG. 1.

FIG. 1 is a perspective view illustrating a paper feeding cassette having a release unit according to an embodiment of the present general inventive concept. FIG. 2 is a perspective view illustrating the release unit of the paper feeding cassette of FIG. 1. FIG. 5 is a cross-sectional view illustrating the operation of feeding a sheet of paper from the paper feeding cassette of FIG. 1.

Referring to FIGS. 1, 2, and 5, a paper feeding cassette 100 may include a cassette main body 110, a paper stacking plate 111, a lift unit 120, and a release unit 130. The paper stacking plate 111 can be installed in the cassette main body 110 to rotate in upward and downward directions, and sheets of paper S are stacked on the paper stacking plate 111. The lift unit 120 can be placed under the paper stacking plate 111 and causes the sheets of paper S stacked on the paper stacking plate 111 to contact a pickup roller 200 or to separate from the pickup roller 200 by ascending or descending the paper stacking plate 111, respectively. The release unit 130 applies a physical force to the lift unit 120 to compulsively descend the paper stacking plate 111 and to remove a force applied to the pickup roller when the sheets of paper S stacked on the paper stacking plate 111 are excessively pressed toward the pickup roller by a force generated by the lift unit 120.

One side of the paper stacking plate 111 can be installed in the cassette main body 110 to rotate in upward and downward directions by a pivot 112 (FIG. 5), and the sheets of paper S can be stacked on the paper stacking plate 111. The paper stacking plate 111 can descend toward a cassette bottom 115 by its weight with the sheets of paper S stacked thereon.

The lift unit 120 may include a rotating pivot 121, a lift lever 123, a protrusion 128, and a connection portion 127. The rotating pivot 121 can be supported by the cassette main body 110 to rotate and can have a plurality of protruding pins 122 opposite to each other at one side. One side of the lift lever 123 can be fixed on the rotating pivot 121, and the other side thereof can contact the paper stacking plate 111. The lift lever 123 can be rotated together with the rotating pivot 121 to cause the paper stacking plate 111 to ascend or descend. The protrusion 128 can be installed to be slid in a direction of a driving pivot 125 of a driving motor 124 installed in a main body of a printer (not shown), be elastically biased in a direction of the rotating pivot 121 by a spring 126, and contact a release portion 1313 that will be described later. The connection portion 127 can have a plurality of cutting parts 129 into which the pins 122 can be inserted to be attached thereto or detached therefrom.

The connection portion 127 is not limited to the above description, and various modifications of the connection portion 127 may be possible so that the connection portion 127 can connect or disconnect a power of the driving motor 124 to or from the rotating pivot 121.

The release unit 130 may include a release lever 131, an opening lever 133, and a connection lever 132. The release lever 131 can be supported by a cassette rear plate 114 to rotate and disconnect the connection portion 127 from the rotating pivot 121. The opening lever 133 can be supported by a cassette front plate 113 to rotate. The connection lever 132 connects the opening lever 133 to the release lever 131 and allows the release lever 131 to pivot when the opening lever 133 is pivoted.

The release lever 131 may include a body 1311, rotating portions 1312, the release portion 1313, and an interlocking portion 1314. The rotating portions 1312 can protrude from both sides of the body 1311 to support the body 1311 and to rotate on the cassette rear plate 114 of the cassette main body 110. The release portion 1313 surrounds the connection portion 127 and contacts the protrusion 128 to force the connection portion 127 of the lift unit 120 to disconnect from the rotating pivot 121. The interlocking portion 1314 is connected to the connection lever 132 and interlocks with the connection lever 132.

The release lever 131 may be installed at an external side of the cassette main body 110 to rotate on the cassette rear plate 114.

The opening lever 133 may include a pressing portion 1331, a main frame 1332, support portions 1333, an elastic portion 1334, and a connection portion 1335. The main frame 1332 can include the pressing portion 1331 to which a force can be applied. The support portions 1333 can protrude from both sides of the main frame 1332 to support the main frame 1332 and to rotate on the cassette front plate 113 of the cassette main body 110. The elastic portion 1334 can surround each of the support portions 1333. One end of the elastic portion 1334 can be fixed at a stopping portion 1336 installed in the main frame 1332, and the other end thereof can be fixed at the cassette front plate 113. The elastic portion 1334 applies an elastic force to the main frame 1332. A connection portion 1335 connects the main frame 1332 to the connection lever 132.

When a user pulls the opening lever 133 by hand, a force is applied to the pressing portion 1331, and the opening lever 133 is rotated around the supporting portion 1333. When a force applied to the opening lever 133 is removed, the opening lever 133 is returned to its original location by the elastic portion 1334.

The connection lever 132 may include a through hole 1321 and an interference portion 1322. The through hole 1321 can be formed at one end of the connection lever 132 so that the connection portion 1335 of the opening lever 133 is inserted into the through hole 1321 and the opening lever 133 is connected to the connection lever 132. The interference portion 1322 can be formed at another end of the connection lever 132 in contact with the interlocking portion 1314 of the release lever 131 to interfere with the release lever 131.

The connection lever 132 may be installed in the cassette bottom 115 to slide in a direction of an arrow A (see FIG. 1). The interference portion 1322 may be installed outside of the cassette main body 110 and contact the interlocking portion 1314 to rotate the release lever 131.

Referring to FIG. 1, a first sensor 220 to sense whether the paper feeding cassette 110 is inserted into a main body (not shown), and a second sensor 210 to sense whether the sheets of paper S stacked on the paper stacking plate 111 are in contact with the pickup roller 200, may be installed in the cassette rear plate 114 or the main body of the printer (not shown).

The operation of the release unit 130 having the above described structure will be described in more detail while referring to FIGS. 1-5.

Figure 3:
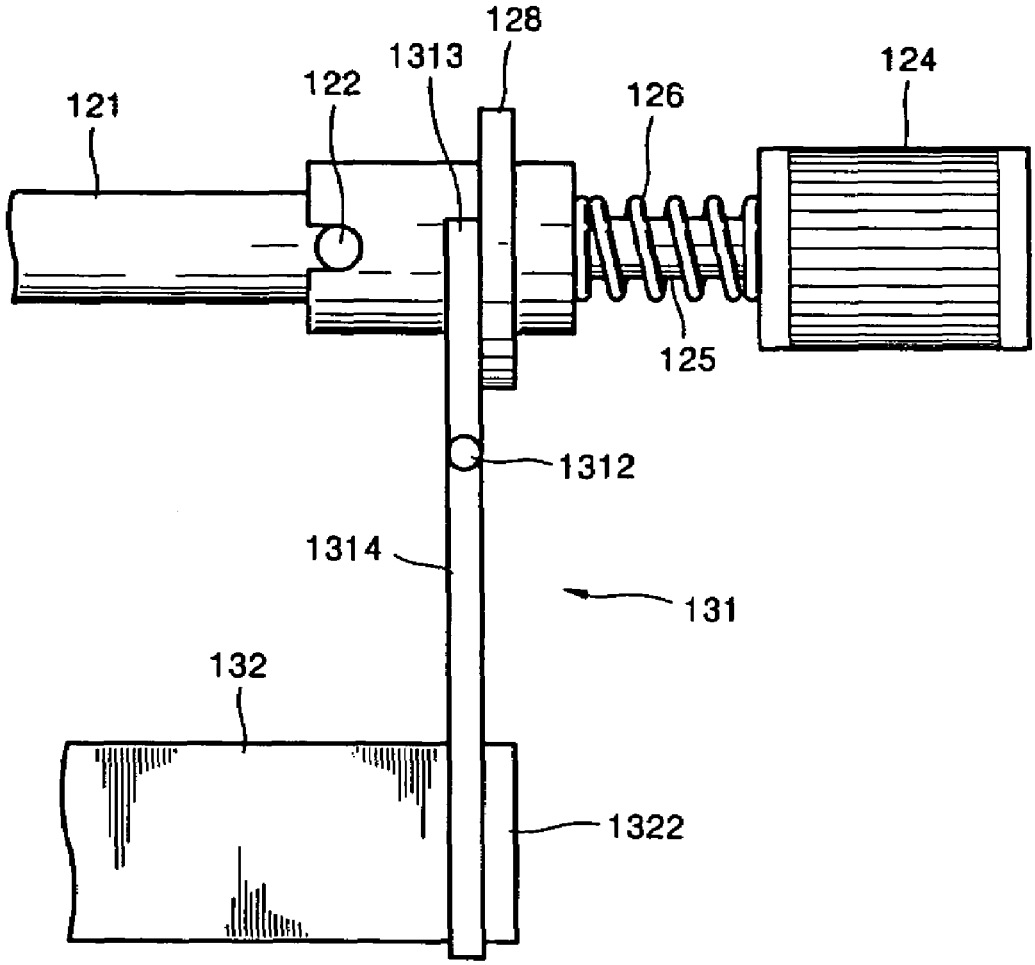
FIGS. 3 and 4 are plan views illustrating an operation of the release unit of the paper feeding cassette of FIG. 1.
Figure 4:
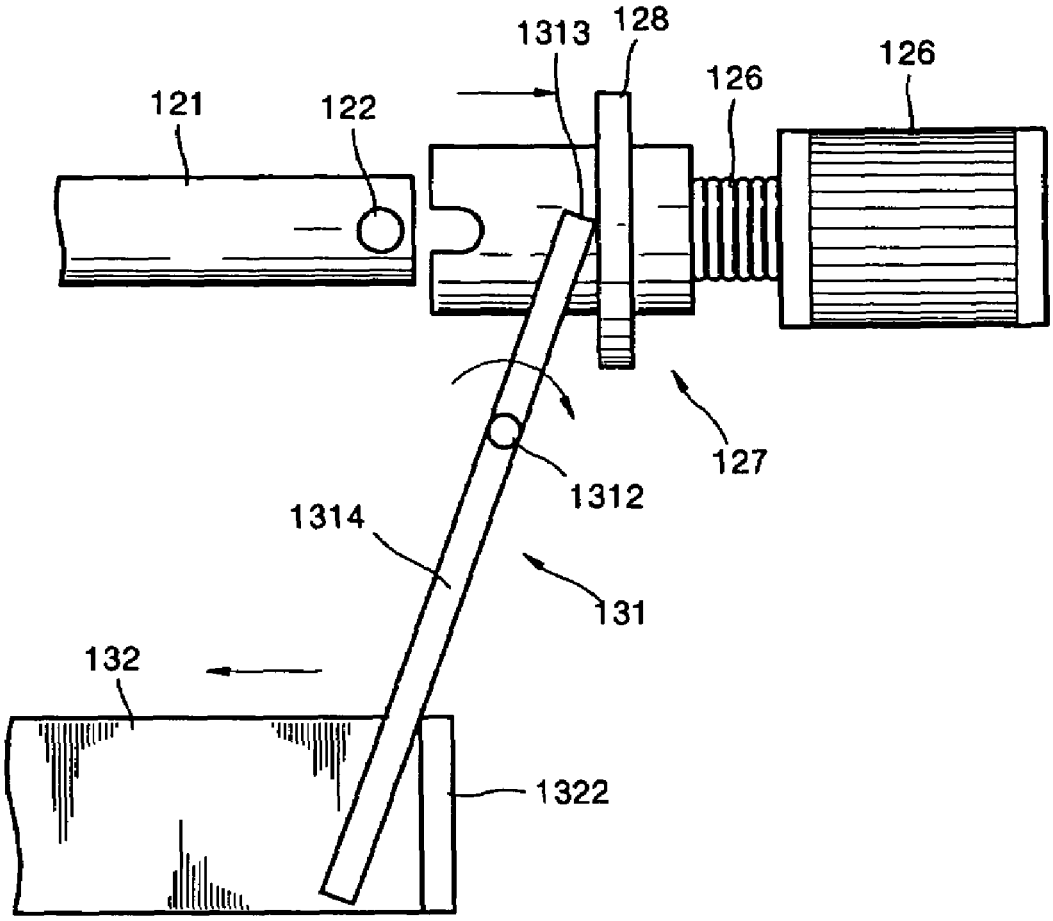

FIGS. 3 and 4 are plan views illustrating the operation of the release unit 130 of the paper feeding cassette of FIG. 1. Referring to FIGS. 1, 2, 3, and 5, when the paper feeding cassette 110 is inserted into the main body of the printer (not shown), the protruding pins 122 of the rotating pivot 121 are inserted into the cutting parts 129 and engage with the cutting parts 129. When the driving motor 124 is rotated, a rotating force is applied to the rotating pivot 121 by the connection portion 127, and the rotating pivot 121 is rotated. Then, the lift lever 123 lifts the paper stacking plate 111, and the sheets of paper S contact the pickup roller 200.

When the driving motor 124 is not properly controlled and the lift lever 123 excessively pushes the paper stacking plate 111 toward the pickup roller 200, it is difficult to pickup the sheets of paper S using the pickup roller 200, and it is difficult to detach the paper feeding cassette 100 from the main body of the printer (not shown).

In this case, as shown in FIGS. 1 and 4, when the user pulls the opening lever 133 toward the cassette front plate 113, the connection lever 132 is slid in a direction of the arrow A (see FIG. 1), and the interference portion 1322 pulls the interlocking portion 1314. Thus, the release lever 131 is rotated around the rotating portions 1312, and the release portion 1313 pushes the protrusion 128 toward the driving motor 124.

Then, the connection portion 127 is slid toward the driving motor 124 in a direction of the driving pivot 125, and the protruding pins 122 are detached from the cutting parts 129 so that the connection portion 127 and the rotating pivot 121 are separated from each other.

When the rotating pivot 121 is separated from the connection portion 127, the paper stacking plate 111 is rotated toward the cassette bottom 115 by a weight of its load. Thus, the sheets of paper S are separated from the pickup roller 200. As a result, the paper feeding cassette 100 may be easily detached from the main body of the printer (not shown).

When the user removes force from the opening lever 133, the connection portion 127 is returned to its original location by an elastic force of the spring 126, and the release lever 131 is returned to its original location. The opening lever 133 is returned to its original location by the elastic force of the elastic portion 1334.

Figure 6:
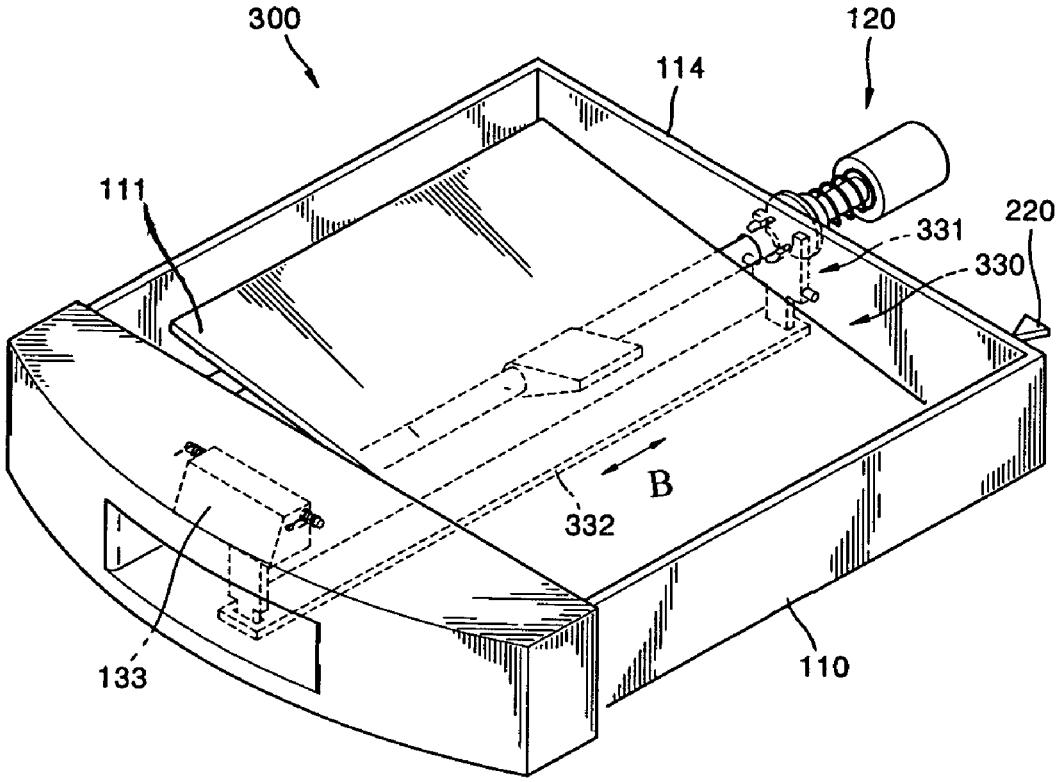
FIG. 6 is a perspective view illustrating a paper feeding cassette having a release unit according to another embodiment of the present general inventive concept.
Figure 7:
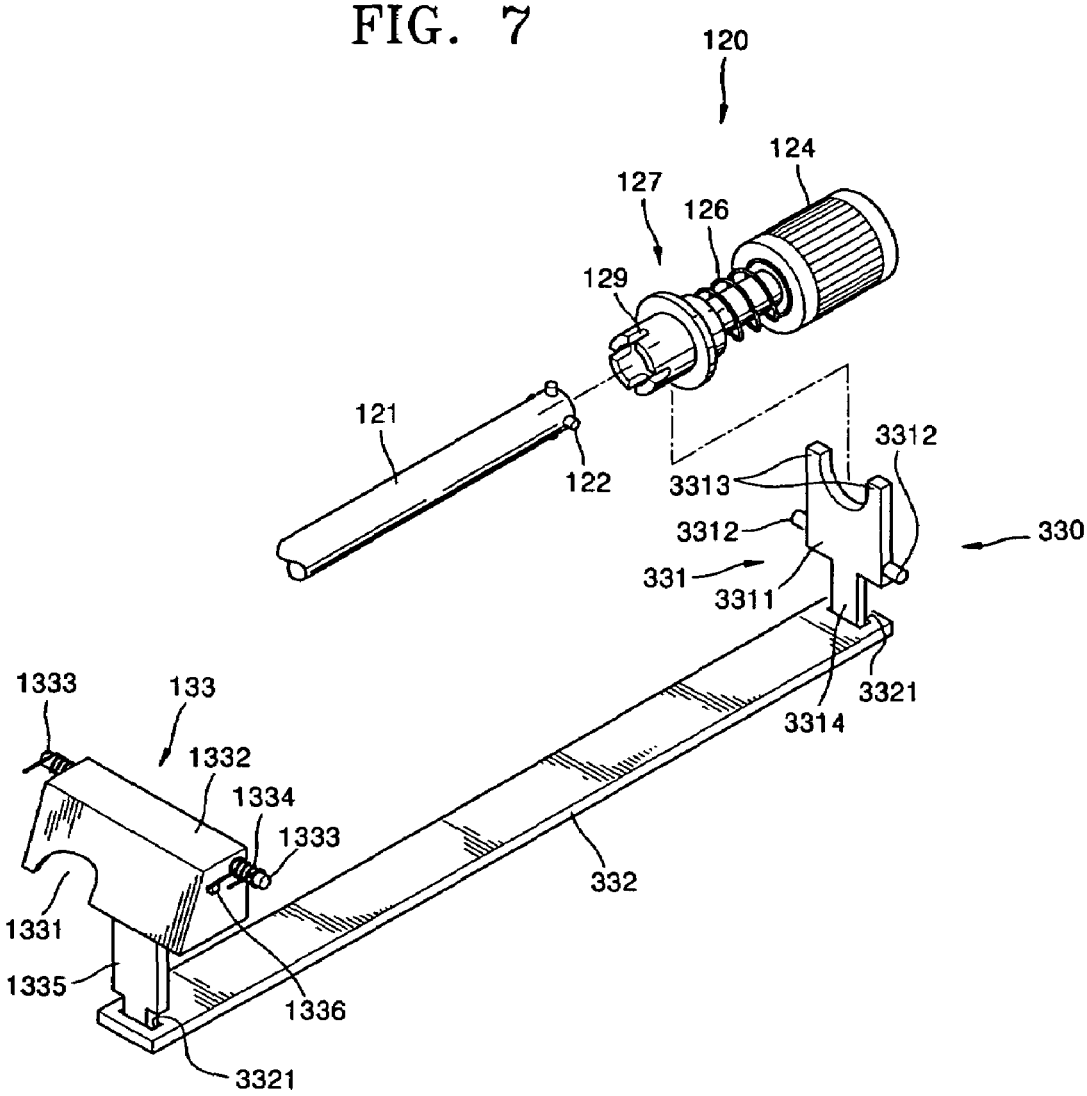
FIG. 7 is a perspective view illustrating the release unit of the paper feeding cassette of FIG. 6.
Figure 8:
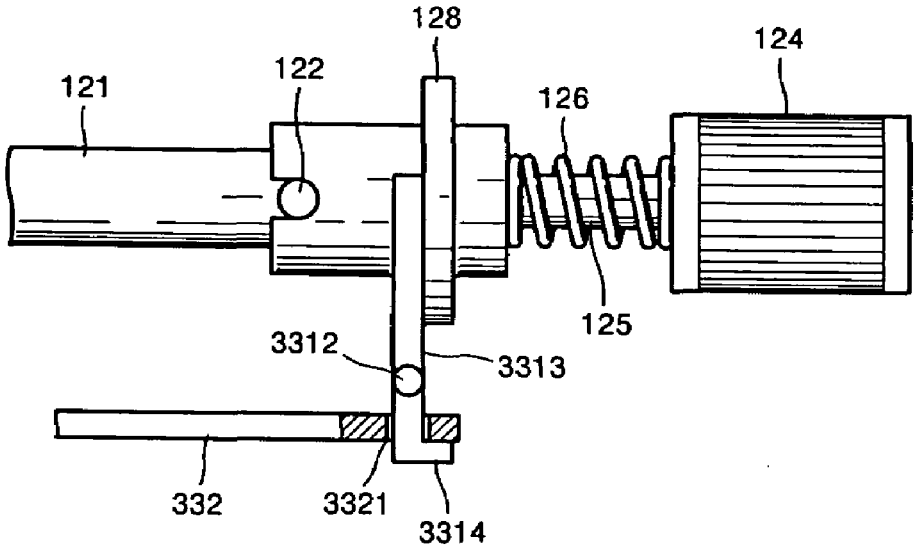
FIGS. 8 and 9 are plan views illustrating the operation of the release unit of the paper feeding cassette of FIG. 6.
Figure 9:
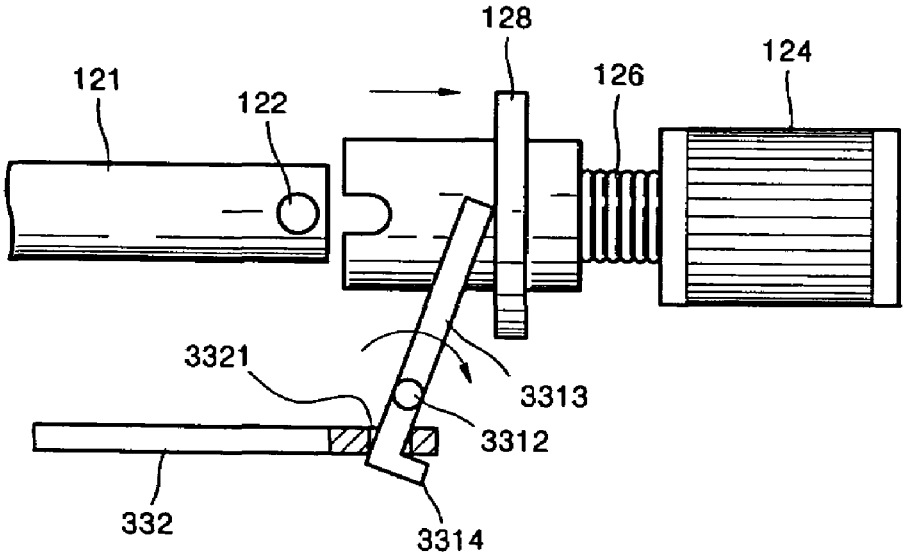

FIG. 6 is a perspective view illustrating a paper feeding cassette having a release unit according to another embodiment of the present general inventive concept. FIG. 7 is a perspective view illustrating the release unit of the paper feeding cassette of FIG. 6. FIGS. 8 and 9 are plan views illustrating the operation of the release unit according of the paper feeding cassette of FIG. 6.

Referring to FIGS. 6 through 9, in a paper feeding cassette 300 of FIG. 6, the paper stacking plate 111 and the lift unit 120 are the same as those of the paper feeding cassette 100 of FIG. 1. The only difference between the paper feeding cassette 110 of FIG. 1 and the paper feeding cassette 300 of FIG. 6 is in a connection lever 332 and a release lever 331 of a release unit 330. The same reference numerals as those of FIGS. 1 through 4 represent the same elements having the same functions, and thus detailed descriptions thereof will be omitted.

The release lever 331 may include a body 3311, rotating portions 3312, a release portion 3313, and an interlocking portion 3314. The rotating portions 3312 may protrude from both sides of the body 3311 to support the body 3311 and to rotate on the cassette rear plate 114 of the cassette main body 110. The release portion 3313 surrounds the connection portion 127 and contacts the protrusion 128 to force the connection portion 127 of the lift unit 120 to disconnect from the rotating pivot 121. The interlocking portion 3314 can be connected to the connection lever 332 and can interlock with the connection lever 332. The release lever 331 may be installed at an external side of the cassette main body 110 to rotate on the cassette rear plate 114.

The connection lever 332 may include through holes 3321 formed at both sides the connection lever 332 so that the connection portion 1335 of the opening lever 133 and the interlocking portion 3314 of the release lever 331 can be inserted into the respective through holes 3321 to connect the opening lever 133 to the release lever 331.

When the user pulls the opening lever 133 toward the cassette front plate 113, the connection lever 332 is slid in a direction of an arrow B and pulls the interlocking portion 3314. Thus, the release lever 331 is rotated around the rotating portions 3312, and the release portion 3313 pushes the protrusion 128 toward the driving motor 124.

Then, the connection portion 127 is slid toward the driving motor 124 in a direction of the driving pivot 125 (see FIG. 8), and the protruding pins 122 are detached from the cutting parts 129 so that the connection portion 127 and the rotating pivot 121 are separated from each other.

As described above, the paper feeding cassettes according to the various embodiments of the present general inventive concept have the following effects. First, when sheets of paper are stacked on a paper feeding plate and any of the sheets of paper is excessively pressed by a pickup roller during a printing operation, the paper feeding cassette can be detached from a main body without damage or deformation of any parts thereof. Second, when the paper feeding cassette is detached from the main body, the paper stacking plate falls first such that the sheets of paper are prevented from being twisted by the pickup roller.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A paper-feeding cassette of an image forming apparatus, the paper feeding cassette comprising:

a paper stacking plate to stack sheets of paper thereon;

a lift unit placed under the paper stacking plate and having a rotating pivot, a driving motor to rotate the rotating pivot to ascend the paper stacking plate, and a connection portion to connect the rotating pivot to the driving motor; and a release unit having a lever unit to separate the connection portion from the rotating pivot to disconnect the driving motor from the rotating pivot to descend the paper stacking plate by its weight and separate the sheets of paper from a pickup roller, wherein the release unit comprises:

a release lever installed at a rear plate of a cassette main body to rotate thereon and to disconnect the connection portion from the rotating pivot, an opening lever installed at a front plate of the cassette main body to rotate thereon, and a connection lever to connect the opening lever to the release lever and to rotate the release lever when the opening lever is rotated, and wherein through holes are formed at both sides of the connection lever to indirectly connect the opening lever and the release lever to each other through the connection lever.

2. The paper feeding cassette of claim 1, wherein the opening lever comprises:

a main frame having a pressing portion to which a force is applied;

support portions protruding from both sides of the main frame to support the main frame to rotate on the cassette main body;

an elastic portion to apply an elastic force to the main frame; and an opening lever connection portion connected to the connection lever to interlock therewith, wherein when the force is applied to the pressing portion, the main frame is rotated around the support portions, and when force is removed from the pressing portion, the main frame is returned to its original location by the elastic force of the elastic portion.

3. The paper feeding cassette of claim 1, wherein the release lever comprises:

a body;

rotating portions protruding from both sides of the body to support the body to rotate on the cassette main body;

a release portion to contact the connection portion and force the connection portion to disconnect from the rotating pivot; and an interlocking portion connected to the connection lever to interlock therewith.

4. The paper feeding cassette of claim 1, wherein a through hole is formed on one end of the connection lever so that the opening lever is connected to the connection lever, and an interference portion is formed at another end of the connection lever to interfere with the release lever.

5. The paper feeding cassette of claim 1, wherein the connection portion is installed to be slid in a direction of a rotating pivot of the driving motor, and a plurality of cutting parts are formed at one side of the connection portion so that pins formed at one end of the rotating pivot are inserted therein.

6. The paper feeding cassette of claim 5, wherein the connection portion is elastically biased in a direction of the rotating pivot by a spring.

7. A paper feeding cassette of an image forming apparatus, the paper feeding cassette comprising:

a paper stacking plate to stack paper thereon;

a lift unit to lift the paper stacking plate; and a release unit having a lever unit to lower the paper stacking plate by application of an external force thereto, wherein the lift unit comprises:

a lift lever disposed under the paper stacking plate to lift the paper stacking plate;

a rotating pivot connected to the lift lever to transfer a rotational force to the lift lever;

a driving motor to provide the rotational force to the rotating pivot; and a lift unit connection portion to selectively connect and disconnect the driving motor and the rotating pivot, and wherein the release unit comprises:

a release lever to disconnect the lift unit connection portion from the rotating pivot, an opening lever to receive the external force, end a connection lever to connect the opening lever and the release lever and to transfer the external force of the opening lever to the release lever, and wherein the connection lever is connected to the opening lever and to the release lever so that the opening lever is parallel to the release lever.

8. The paper feeding cassette of claim 7, wherein the opening lever comprises:

a main frame having a pressing portion to which the force is applied;

support portions protruding from both sides of the main frame to support the main frame and allow the main frame to rotate;

an elastic portion to apply an elastic force to the main frame; and an opening lever connection portion connected to the connection lever and interlocking therewith, wherein when the force is applied to the pressing portion, the main frame is rotated with respect to the support portions, and when the force is removed from the pressing portion, the main frame is returned to its original location by the elastic force of the elastic portion.

9. The paper feeding cassette of claim 7, wherein the release lever comprises:

a body;

rotating portions protruding from both sides of the body to support the body and allow the body to rotate;

a release portion to contact the lift unit connection portion and cause the lift unit connecting portion to disconnect from the rotating pivot; and an interlocking portion connected to the connection lever and interlocking therewith.

10. The paper feeding cassette of claim 7, wherein the connection lever is connected to the opening lever and to the release lever so that the release lever is perpendicular to the opening lever.

11. The paper feeding cassette of claim 7, wherein the lift unit further comprises:

a plurality of cutting parts formed in the lift unit connection portion;

a plurality of pins formed in an end of the rotating pivot to be inserted into the plurality of cutting parts;

a protrusion formed in the lift unit connection portion to be contacted by the release unit; and a spring to elastically bias the lift unit connection portion in a direction of the rotating pivot.

12. A paper feeding cassette having a paper stacking plate to lift sheets of paper toward a feeding roller, comprising:

a rotatable pivot shaft having a lift lever extending therefrom to rotate with the pivot shaft when a rotational force is applied thereto to contact and lift the paper stacking plate toward the feeding roller; and a release unit having a lever unit to release the rotational force from the pivot shaft and retract the paper stacking plate away from the feeding roller when an external force is applied to the release unit, wherein the release unit comprises:

a connection portion having a first member connected to the pivot shaft and a second member connected to the rotational force, a release lever to separate the first member from the second member when the external force is applied to the release unit, and a connection lever having one end engagable with the release lever and another end including an opening lever connected thereto and positioned at a front portion of the paper feeding cassette to receive the external force.

13. The paper feeding cassette of 12, wherein the first member includes pins extending from the pivot shaft and the second member includes slotted portions extending therefrom to engage with the pins.

14. The paper feeding cassette of claim 12, wherein the opening lever comprises:

a main frame having a pressing portion to receive the external force;

support portions protruding from both sides of the main frame to support the main frame to rotate on the cassette main body;

an elastic portion to apply an elastic force to the main frame; and an opening lever connection portion connected to the connection lever to interlock therewith, wherein when the external force is applied to the pressing portion, the main frame is rotated around the support portions, and when force is removed from the pressing portion, the main frame is returned to its original location by the elastic force of the elastic portion.

* * * * *